United States Patent [19]

Weil

[11] Patent Number: 4,821,754

[45] Date of Patent: Apr. 18, 1989

[54] FLITCH WASHER

[75] Inventor: George Weil, Missisauga, Canada

[73] Assignee: David R. Webb Co., Inc., Edinburg, Ind.

[21] Appl. No.: 613,276

[22] Filed: May 24, 1984

Related U.S. Application Data

[63] Continuation-in-part of Ser. No. 562,460, Dec. 16, 1983.

[51] Int. Cl.[4] ..... B08B 1/02

[52] U.S. Cl. ..... 134/64 R; 134/72; 134/122 R; 134/111; 134/199

[58] Field of Search ..... 134/61, 68, 72, 78, 134/111, 109, 110, 122 R, 199, 131, 64 R; 144/340; 210/396, 397

[56] References Cited

U.S. PATENT DOCUMENTS

| | | | |
|---|---|---|---|
| 876,301 | 1/1908 | Cunningham . | |
| 1,087,959 | 2/1914 | Liserness et al. | 144/208 D |
| 1,609,474 | 12/1926 | Jacobson | 134/122 R |
| 1,661,356 | 3/1928 | Baker | 144/208 D |
| 1,790,756 | 2/1931 | Lowery | 134/122 R |
| 1,910,497 | 5/1933 | Peik | 144/208 D |
| 2,097,529 | 11/1937 | Nordell | 210/396 X |
| 2,140,287 | 12/1938 | Guettler | 144/208 |
| 2,261,560 | 11/1941 | Pellas et al. | 134/61 X |
| 2,328,545 | 9/1943 | Bukowsky | 144/208 |
| 2,338,136 | 1/1944 | Shaw et al. | 144/208 |
| 2,394,514 | 2/1946 | Evans et al. | 134/122 R X |
| 2,422,757 | 6/1947 | Swift | 144/208 |
| 2,576,861 | 11/1951 | Shaw et al. | 144/208 |
| 2,615,481 | 10/1952 | Horstkotte | 144/208 |
| 2,616,437 | 11/1952 | Secor | 134/122 |
| 2,664,929 | 1/1954 | Simons | 144/208 |
| 2,682,185 | 6/1954 | Lucier et al. | 78/18 |
| 2,687,152 | 8/1954 | Hansel . | |
| 2,738,814 | 3/1956 | Latimer | 144/208 D |
| 2,799,308 | 7/1957 | Makinson | 144/309 |
| 2,809,683 | 10/1957 | Hoiss | 144/208 |
| 3,570,504 | 3/1971 | Frantzen | 134/64 |
| 3,633,593 | 1/1972 | Slaats | 134/64 |
| 3,709,268 | 1/1973 | Tuuha | 144/208 |
| 3,827,097 | 8/1974 | Hamann | 134/122 R X |
| 3,858,860 | 1/1975 | Randall | 266/6 |
| 3,942,565 | 3/1976 | Ratelle et al. | 144/311 |
| 3,986,710 | 10/1976 | Day et al. | 266/129 |
| 4,047,549 | 9/1977 | Ratelle et al. | 134/122 R X |
| 4,209,403 | 6/1980 | Dorgathen | 210/396 X |
| 4,243,527 | 1/1981 | Leonard | 210/397 X |
| 4,355,433 | 10/1982 | Dietrich | 134/63 X |
| 4,370,228 | 1/1983 | Tashiro et al. | 210/396 X |
| 4,432,403 | 2/1984 | Heikkinen | 144/208 B X |

FOREIGN PATENT DOCUMENTS

| | | | |
|---|---|---|---|
| 2284688 | 4/1976 | France . | |
| 2419773 | 10/1979 | France . | |
| 217021 | 1/1942 | Switzerland . | |
| 719666 | 3/1980 | U.S.S.R. | 210/396 |

*Primary Examiner*—Harvey C. Hornsby
*Assistant Examiner*—Frankie L. Stinson
*Attorney, Agent, or Firm*—Barnes & Thornburg

[57] ABSTRACT

A flitch washer includes inner and outer cylinders, the space between which is closed at its ends by bulkheads. The inner cylinder defines a passageway open at an entry end and an exit end. A conveyor is provided for conveying a flitch through the passageway from the entry end to the exit end. Nozzle openings are provided through the inner cylinder into the space. Nozzles and plugs are inserted into the nozzle openings to provide a desired pattern of spray of a washing fluid from the space between the cylinders through the nozzles into the passageway. A filter mechanism is provided for trapping debris and the like removed from the flitches by the washing fluid. The filtered washing fluid is then returned to the space between the cylinders for recycling through the nozzles. The filter and conveyor are oriented so that the conveyor also conveys accumulated debris from the filter to a receptacle for disposal.

15 Claims, 8 Drawing Sheets

FLITCH WASHER

This invention is a continuation-in-part of U.S. patent application Ser. No. 562,460 filed Dec. 16, 1983 and still pending.

This invention relates to apparatus for processing logs and flitches in preparation for cutting veneer slices from the flitches.

In the cutting of veneer, flitches that are to be cut are shaped and washed to remove soil, sand and the like from them. Machines for washing logs and flitches are known. There is, for example, the apparatus of U.S. Pat. No. 3,633,593. It has been typical of prior art apparatus for washing flitches that the apparatus requires a high-pressure washing fluid discharge. While it would be advantageous to recirculate such washing fluids, the washing fluids pick up soils and sand from the flitches being washed and, because of the high pressure under which such fluids are provided to wash flitches, these soils and sand could affect deleteriously recirculation in the high-pressure systems in which they are used. These soils and sand, for example, if recirculated, could plug the nozzles of the prior art washing apparatus of the type illustrated in U.S. Pat. No. 3,633,593, since the nozzles of prior art washing apparatus typically are relatively high-pressure nozzles and, therefore, have relatively small nozzle cross sections. The same would be true for bark and other matter picked up during washing by the washing fluid and recirculated. Additionally, these materials, if recirculated, could harm the high-pressure pumps used to maintain pressure in the prior art washing systems.

During the processing of flitches, before they are washed, they are cooked for a period of time in cooking vats. The wood is soft when it comes from the cooking vats. Washing it with water at high pressure destroys the soft outer tissue of the flitches.

Additionally, it must be remembered that after washing, the flitches ultimately must be sliced on a veneer slicer. The presence of soils, sand and other foreign matter in the grain of the flitch surfaces damages the blades of veneer slicers. High pressure prior art washing systems, typically operate in the range of 2000–3000 pounds/inch$^2$ ($1.38\times10^7$ nt/m$^2$–$2.07\times10^7$ nt/m$^2$). The use of high-pressure washing of the type described in the prior art tends to force the soils, sand and like foreign matter into the crevices and soft outer surfaces of the flitches, increasing the likelihood of damage to the veneer slicer blades. This increases the required maintenance of the veneer slicers and also reduces the yield from slicing the flitches.

Spray devices comprising two coaxial cylinders are also known. There are, for example, the washers of U.S. Pat. Nos.: 876,301; 3,858,860; and 3,986,710. Some of these prior art systems, illustratively, U.S. Pat. No. 3,858,860 disclose the use of nozzles in the inner wall of an inner cylinder to direct a spray of liquid onto an object passing through the inner cylinder. The nozzles of such prior art systems typically are permanently located in the inner wall of the inner cylinder.

According to the present invention, a washer for a flitch or the like comprises means defining a passageway open at an entry end and an exit end, means for conveying a flitch through the passageway from the entry end to the exit end, means defining a plurality of nozzles along the walls of the passageway for discharging a washing fluid into the passageway, and means for supplying washing fluid to the nozzles.

Illustratively, according to the present invention, the means defining a passageway comprises a cylinder. In illustrative embodiments, the cylinder is a generally right circular cylinder.

According to another aspect of the invention, the means defining a plurality of nozzles along the walls of the passageway comprises means defining openings through the passageway, and a plurality of nozzles for engaging the opening. Additionally, according to the invention, a plurality of plugs are provided for engaging the openings. The nozzles and plugs engage the openings in a selected pattern to provide a selected spray pattern for the washing fluid into the passageway.

According to yet another aspect of the invention, the means for supplying washing fluid to the nozzles comprises a second cylinder, the axis of which extends parallel to the axis of the first cylinder. Means are provided for closing the spaces between the ends of the first and second cylinders to define a volume between them. Means providing a supply opening through the second cylinder and into the volume to supply washing fluid to the nozzles are also provided. Illustratively, the means for closing the spaces between the ends of the first and second cylinders to define the volume between them comprises bulkheads.

According to another aspect of the present invention the washer for a flitch includes means for recycling said washing fluid, means for trapping debris beneath the means for conveying a flitch and means for conveying the trapped debris away from the washer for disposal.

The invention may best be understood by referring to the following description and accompanying drawings which illustrate the invention. In the drawings.

Figure 1:
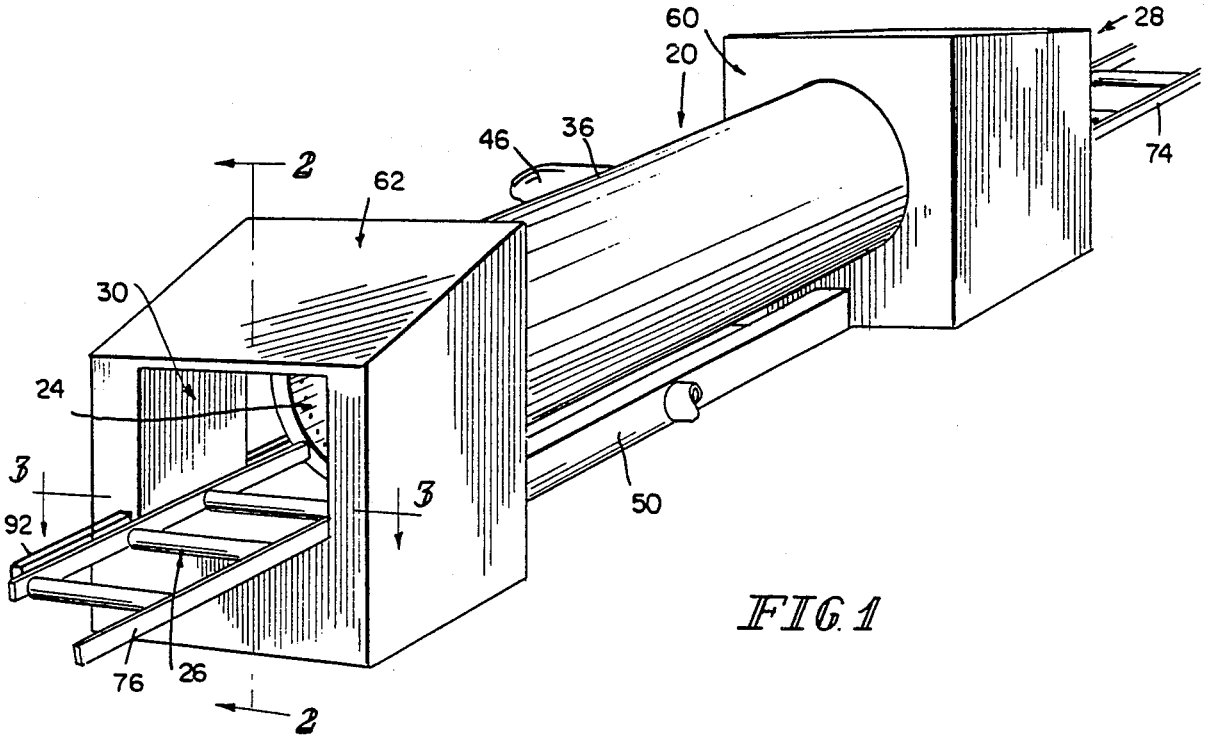
FIG. 1 is a perspective view of an embodiment of the flitch washer.
Figure 4:
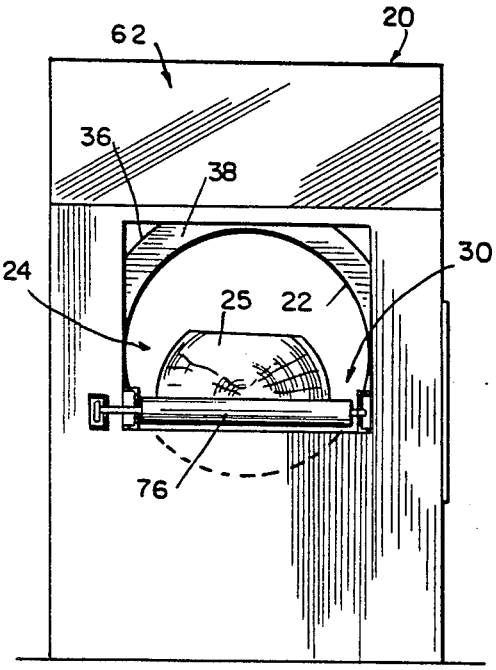
FIG. 4 is an end elevational view of the flitch washer of FIGS. 1–3, taken generally along section lines 4—4 of FIG. 2.

With particular reference now to FIGS. 1–6, a flitch washer 20 includes an inner, generally right circular cylinder 22 defining a passageway 24 through which a flitch 25 is conveyed on a conveyor 26. The flitch 25 passes along the conveyor 26 from an entry end 28 of the passageway 24 to an exit end 30 thereof. While in the passageway 24, the flitch 25 is washed thoroughly by a washing fluid, such as recirculating water, expelled under relatively low pressure and at high volume from nozzles 32 screw-threaded (FIG. 6) into openings 33 provided in the side wall of the inner cylinder 22.

Figure 2:
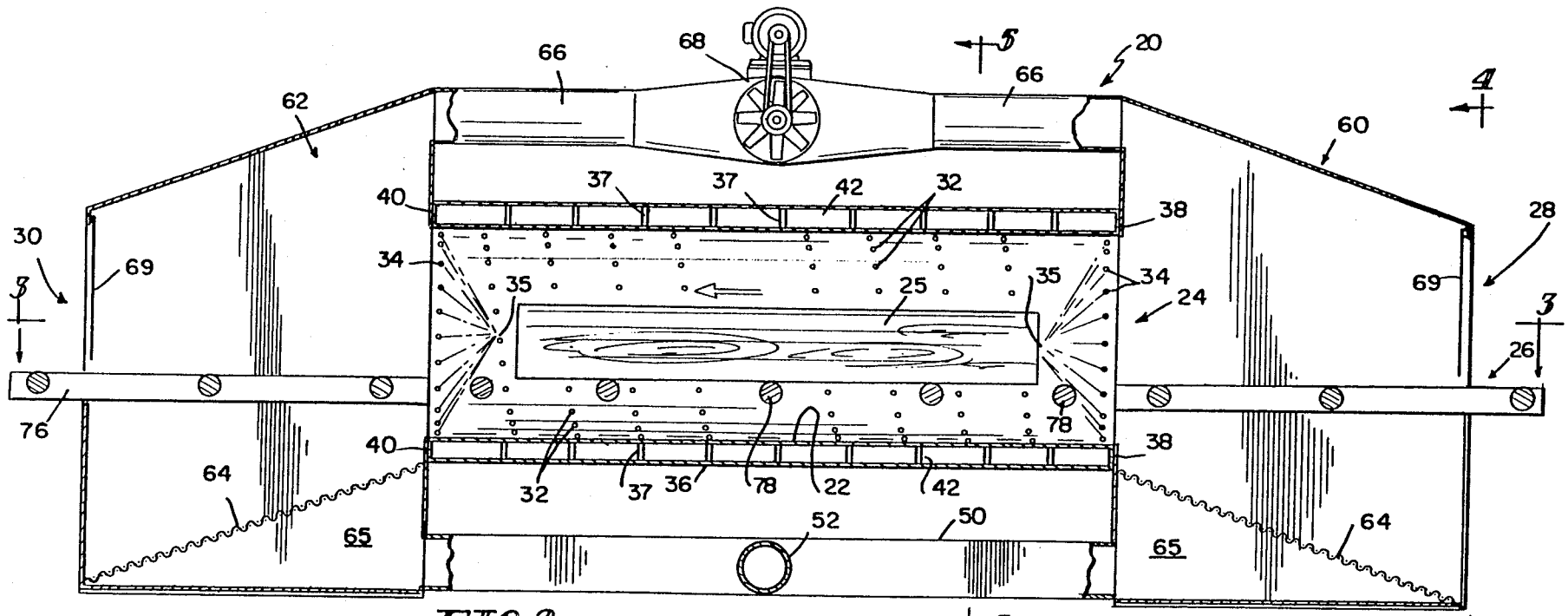
FIG. 2 is a longitudinal sectional elevational view of the flitch washer of FIG. 1, taken generally along section lines 2—2 thereof.
Figure 3:
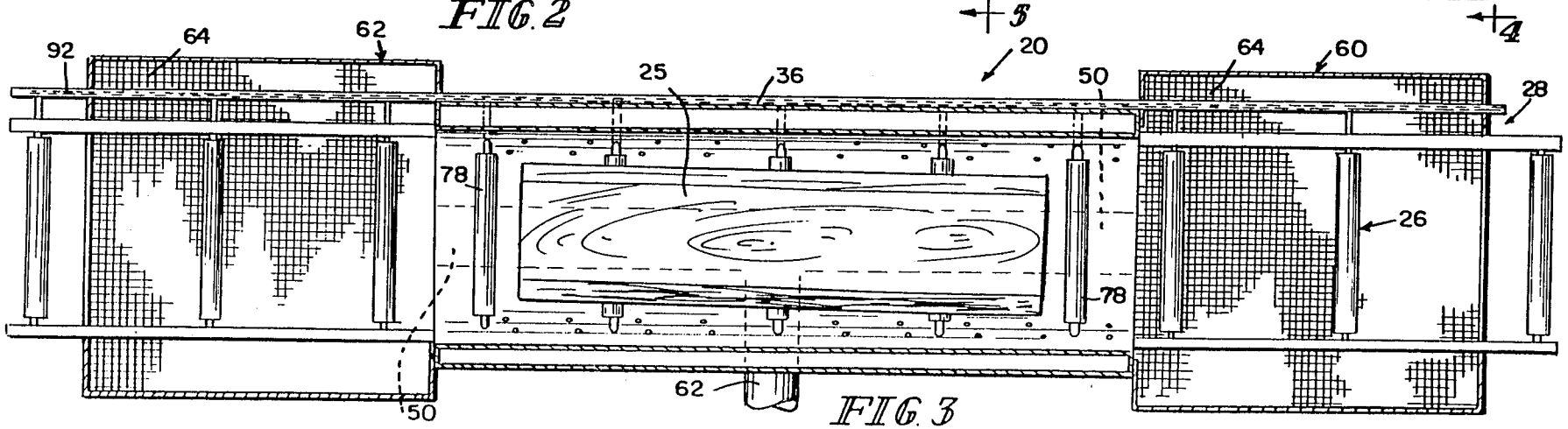
FIG. 3 is a longitudinal sectional plan view taken generally along section lines 3—3 of the flitch washer of FIGS. 1–2.
Figure 6:
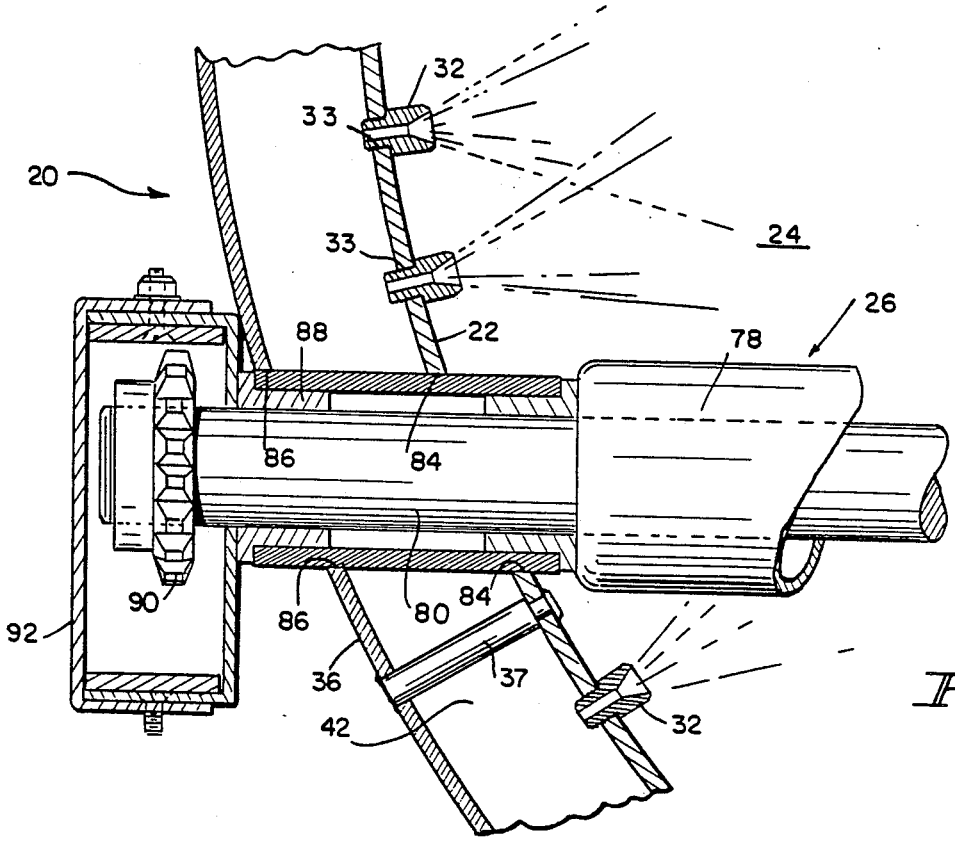
FIG. 6 is an enlarged detail of the flitch washer of FIGS. 1–5.
Figure 7:
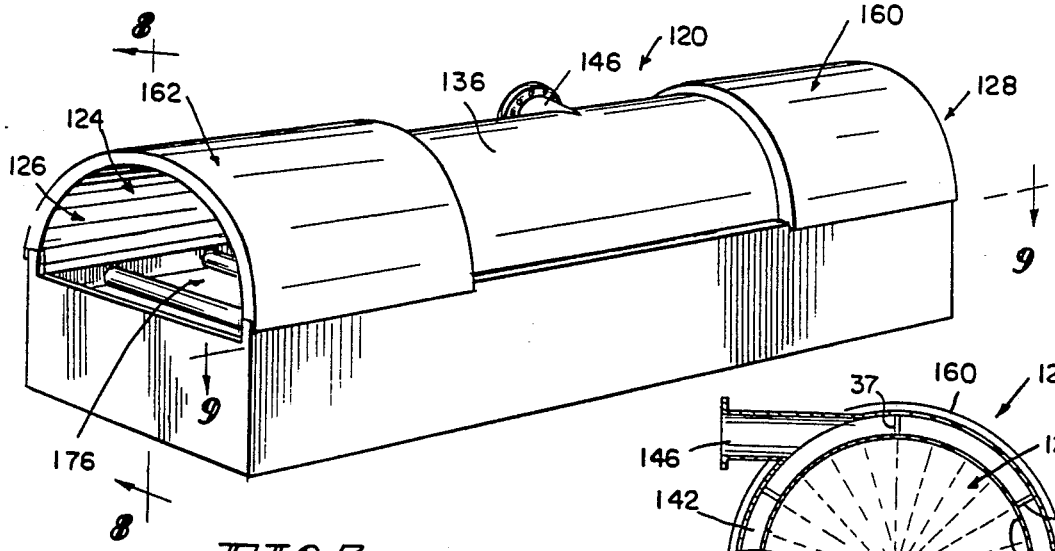
FIG. 7 is a perspective view of an embodiment of the flitch washer.

As best illustrated in FIG. 2, the nozzle openings 33 are formed into one or more coaxial helical patterns. The single dots in FIG. 2 illustrate the positions of the nozzle openings 33 on the side of the cylinder 22 illustrated in the elevational view of FIG. 2. The patterns of four dots illustrate the positions of the nozzle openings 33 on the side of the cylinder 22 cut away in the sectional elevation of FIG. 2 for purposes of illustration. The end, generally vertically extending rows 34 of nozzles 32 can be provided with nozzles which direct their sprays not only inwardly toward the axis of cylinder 22, but also inwardly toward the center of the longitudinal extent of the cylinder 22, as best illustrated at 35 in FIG. 2.

The flitch washer 20 also includes an outer, generally right circular cylinder 36 which is attached intermediate its ends by rod-like spacer/supports 37 to the intermediate regions of the inner, generally right circular cylinder 22 to form a volume 42. Outer cyclinder 36 is also attached at its ends by bulkheads 38, 40 to the ends of cylinder 22. Cylinder 36 is provided with a washing fluid supply opening 44 (FIG. 5) which is coupled by means of a conduit 46 to a high-volume, lowpressure pump 48 which pumps washing fluid into the volume 42. A well conduit 50 communicates by means of a return line 52 to the inlet to pump 48. The entry end 28 and exit end 30 of passageway 24 are provided with respective entry end hood 60 and exit end hood 62. The downwardly and outwardly inclined inner floors 64 of entry end hood 60 and exit end hood 62 illustratively are constructed from a grate-type material, such as expanded metal, to permit some filtering and the drainage of washing fluid from the entry and exit ends 28, 30 of passageway 24 and from the flitches which exit from exit end 30 on conveyor 26 to be collected in regions 65 of hoods 60, 62 for recovery in well 50 and recirculation through the return line 52 to the pump 48. A spray curtain 69 (FIG. 2) can be added to the outer opening of each of hoods 60, 62 as needed to prevent washing fluid from splashing or spraying beyond the hood 60, 62 openings. If necessary, a filter 67 (FIG. 5) can be provided in the return line 52 to filter bark, soil, sand and other debris from the washing fluid prior to entry to the pump 48 inlet.

The entry end hood 60 and exit end hood 62 also communicate with conduits 66 (FIG. 2), and through conduits 66 and a blower 68 with a conduit 70 (FIG. 5) which leads to a condenser room 72. Washing fluid which has vaporized and collects in the entry end hood 60 and exit end hood 62 is recovered and circulated through conduits 66, 70 under the influence of the blower 68 for condensation and return to the recirculating system for pump 48. The large volume of water flowing in the flitch washer creates a considerable vacuum within the flitch washer and draws off the water vapor with the water which is being recirculated. The vapor recovery fan 68 can be removed from the system if a sufficiently high volume of water is used.

Figure 5:
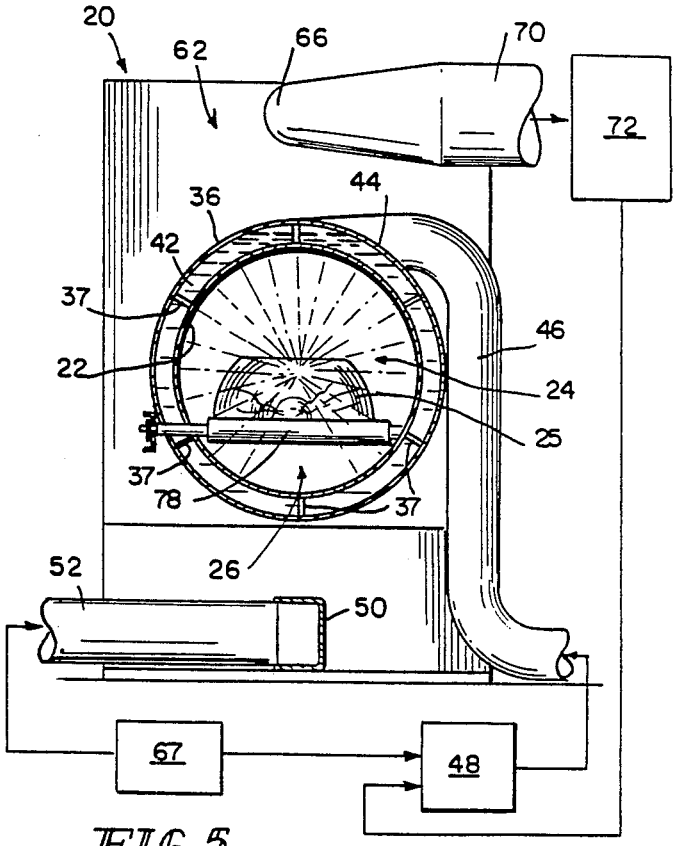
FIG. 5 is a sectional view of the flitch washer of FIGS. 1–4, taken generally along section lines 5—5 of FIG. 2.

Turning now to the conveyor 26, it includes an entry end conveyor portion 74 and an exit end conveyor portion 76 of generally conventional construction. A central conveyor portion, which lies within the passageway 24, comprises a plurality of generally uniformly spaced rollers 78 (FIG. 6) constructed from a material, such as rubber, which is generally non-reactive with the washing fluid and other materials with which the washing fluid becomes contaminated during use. Each roller 78 is mounted on a drive shaft 80, one end of which is rotatably mounted, as best illustrated in FIG. 5, from the interior wall of cylinder 22. The other end of each drive shaft 80 extends through a passageway 82 which itself extends through openings 84, 86, provided in the inner and outer cylinders 22, 36, respectively. Passageway 82 is provided with bushings 88 to mount the drive shaft rotatably within the passageway 82. The ends of the drive shafts 80 which extend beyond the outer bushing 88 are provided with sprockets 90. The sprockets 90 are all housed in an elongated common guard 92 which includes space for a drive chain (not shown) to be trained about the sprockets 90 and about a drive sprocket for the rollers 78. This drive sprocket (not shown) is rotated to drive flitches 25 along the conveyor 26.

An illustrative system constructed according to this embodiment had a total length of 16 feet (4.88 meters), including entry and exit end hood 60, 62, lengths of 4 feet (1.22 meters). The width of each of the entry and exit end hoods 60, 62, as viewed in FIG. 4 was also 4 feet (1.22 meters). The diameter of the passageway 24 illustratively was 30 inches (76.2 centimeters). The height of the passageway 24 from the tops of the rollers 78 to the top of the passageway 24 illustratively was 23 inches (98.4 centimeters). The diameter of the outer cylinder 36 illustratively was 39 inches (99 centimeters). The width of the entry and exit conveyor portions 74, 76 was 32 inches (81 centimeters), and the width of the conveyor 26 in the roller 78 region was 24 inches (61 centimeters). Conduit 46 had a diameter of about 6 inches (15.2 centimeters), return line 52 had a width of about 6 inches (15.24 centimeters) and a height of about 8 inches (20.3 centimeters). Conduit 66 had a diameter of about 8 inches (20.3 centimeters) and conduit 70 had a diameter of about 12 inches (30.5 centimeters). The height of the washer 20 to the top of the entry and exit hoods 60, 62 was 72 inches (1.83 meters), and the height to the top of the conveyor 26 was 32 inches (81.3 centimeters). Recirculating water was the washing fluid. Pump 48 supplied water at 150 pounds per square inch at 800 gallons per minute and 160° F. The washer was constructed generally from stainless steel.

With particular reference now to FIGS. 7–11, a flitch washer 120 includes an inner, generally right circular cylinder 122 defining a passageway 124 through which a flitch 125 is conveyed on a conveyor 126. The flitch 125 passes along the conveyor 126 from an entry end 128 of the passageway 124 to an exit end 130 thereof. While in the passageway 124, the flitch 125 is washed thoroughly by a washing fluid, such as recirculating water, expelled under relatively low pressure and at high volume from nozzles 132 screw-threaded (FIG. 11) into openings 133 provided in the side wall of the inner cylinder 122.

Figure 8:
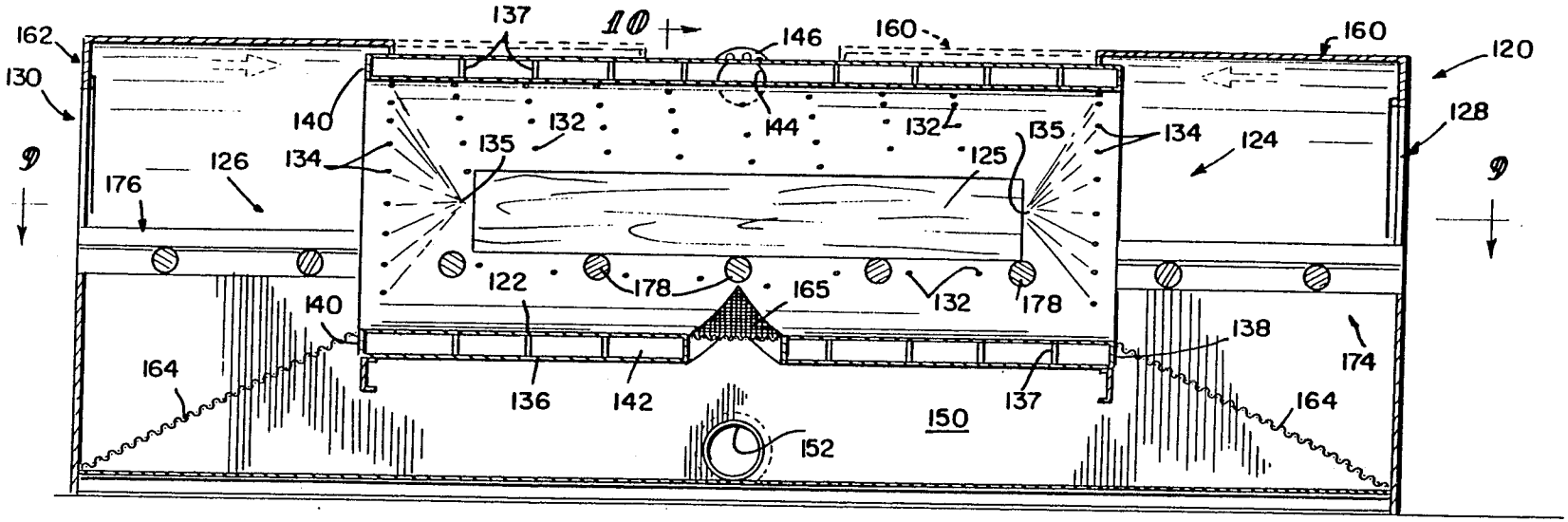
FIG. 8 is a longitudinal sectional elevational view of the flitch washer of FIG. 7, taken generally along section lines 8—8 thereof.
Figure 9:
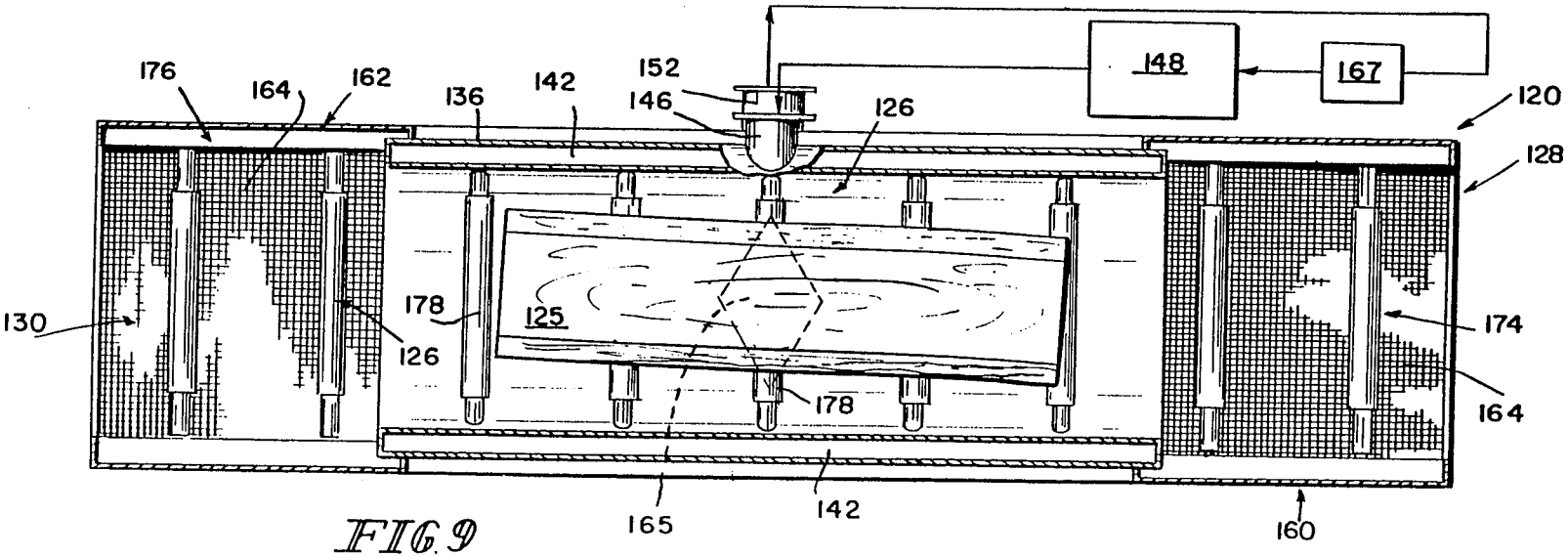
FIG. 9 is a longitudinal sectional plan view taken generally along section lines 9—9 of the flitch washer of FIGS. 7–8.
Figure 11:
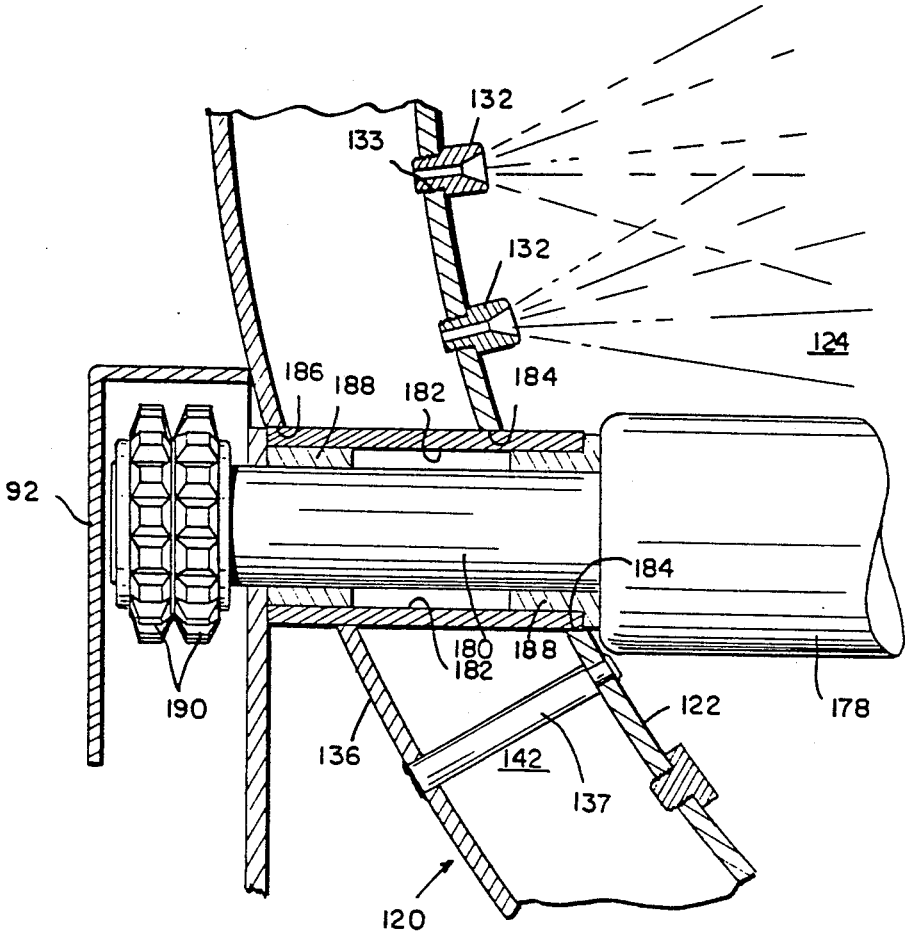
FIG. 11 is an enlarged detail of the flitch washer of FIGS. 7–10.

As best illustrated in FIG. 8, the nozzle openings 133 are formed into one or more coaxial helical patterns. The end, generally vertically extending rows 134 of nozzles 132 can be provided with nozzles which direct their sprays not only inwardly toward the axis of cylinder 122, but also inwardly toward the center of the longitudinal extent of the cylinder 122, as best illustrated at 135 in FIG. 8.

The flitch washer 120 also includes an outer, generally right circular cylinder 136 which is attached intermediate its ends by rod-like spacer/supports 137 to the intermediate regions of the inner, generally right circular cylinder 122 to form a volume 142. Outer cylinder 136 is also attached at its ends by bulkheads 138, 140 to the ends of cylinder 122. Cylinder 136 is provided with a washing fluid supply opening 144 (FIGS. 8–9) which is coupled by means of a conduit 146 to a high-volume, low-pressure pump 148 which pumps washing fluid into the volume 142. A well 150 communicates by means of a return line 152 to the inlet to pump 148. The entry end 128 and exit end 130 of passageway 124 are provided with respective entry end hood 160 and exit end hood 162. The downwardly and outwardly inclined inner floors 164 of entry end hood 160 and exit end hood 162 illustratively are constructed from a grate-type material, such as expanded metal, to permit some filtering and the drainage of washing fluid from the entry and exit ends 128, 130 of passageway 124 and from the flitches which exit from exit end 130 on conveyor 126 to be collected in well 150 for recirculation through the return line 152 to the pump 148. A somewhat diamond shaped drain 165 is provided through the walls of both of cylinders 122, 136 at the bottom center of passageway 124 for this purpose. The shape of the drain 165 also helps channel the high volume of water into the two ends of the volume 142. An additional filter 167 (FIG. 9) is provided in the return line 152 to help filter bark, soil, sand and other debris from the washing fluid prior to entry to the pump 148 inlet.

Figure 10:
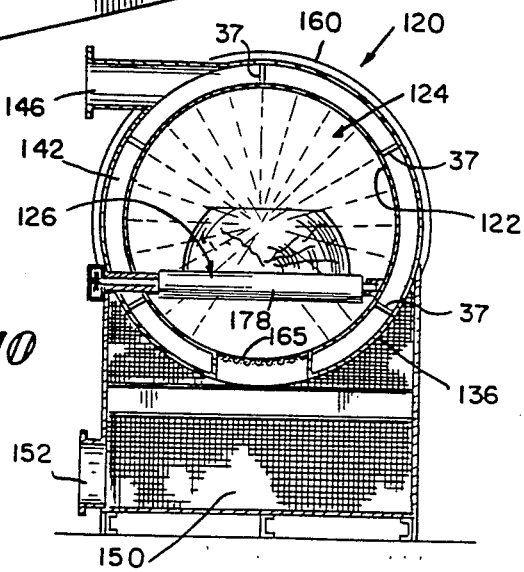
FIG. 10 is a sectional view of the flitch washer of FIGS. 7–9, taken generally along section lines 10—10 of FIG. 8.

Turning now to the conveyor 126, it includes an entry end conveyor portion 174 and an exit end conveyor portion 176. A central conveyor portion, which lies within the passageway 124, comprises a plurality of generally uniformly spaced rollers 178 (FIG. 11) constructed from a material which is generally non-reactive with the washing fluid and other materials with which the washing fluid becomes contaminated during use. Each roller 178 is mounted on a drive shaft 180, one end of which is rotatably mounted, as best illustrated in FIG. 10, from the interior wall of cylinder 122. The other end of each drive shaft 180 extends through a passageway 182 which itself extends through openings 184, 186, provided in the inner and outer cylinders 122, 136, respectively. Passageway 182 is provided with bushings 188 to mount the drive shaft rotatably within the passageway 182. The ends of the drive shafts 180 which extend beyond the outer bushing 188 are provided with sprockets 190. The sprockets 190 are housed in an elongated common guard 192 which includes space for a drive chain (not shown) to be trained about the sprockets 190 and about a drive sprocket for the rollers 178. This drive sprocket (not shown) is rotated to drive flitches 125 along the conveyor 126.

An illustrative system constructed according to this embodiment had a total length of 14 feet (4.27 meters), including entry and exit end hood 160, 162, lengths of 3 feet (91.4 centimeters). The width of each of the entry and exit end hoods 160, 162, as viewed in FIG. 10 was 42 inches (1.07 meters). The diameter of the passageway 124 illustratively was 30 inches (76.2 centimeters). The height of the passageway 124 from the tops of the rollers 178 to the top of the passageway 124 illustratively was 23 inches (98.4 centimeters). The diameter of the outer cylinder 136 illustratively was 39 inches (99 centimeters). The width of the entry and exit conveyor portions 174, 176 was 32 inches (81 centimeters), and the width of the conveyor 126 in the roller 178 region was 24 inches (61 centimeters). Conduit 146 had a diameter of about 6 inches (15.2 centimeters), return line 152 had a diameter of about 8 inches (20.3 centimeters). The height of the washer 120 to the top of the entry and exit hoods 160, 162 was 60 inches (1.52 meters), and the height to the top of the conveyor 126 was 32 inches (81.3 centimeters). Recirculating water was the washing fluid. Pump 148 supplied water at 150 pounds per square inch at 800 gallons per minute and 160° F.

One system according to the invention recycles 4,000 gallons (15,147.5 kg) at 800 gallons/min, for three days of two shift-per-day operation. With this amount of water recycling at this rate, 1,200 flitches can be washed. The inclined filters 164 at the entry and exit ends of the flitch washer are cleared of wood fiber about twice a day. The filter 167 in the recycle water storate vat is cleaned once every three days, when the recycle water is renewed.

The present system operates at a pressure of at most one-tenth that of the prior art systems, or 200 pounds/in$^2$ ($1.38 \times 10^6$ nt/m$^2$). Combined with the much lower pressure washing, the present system uses a very high volume of water, which cannot be achieved with prior art systems using small, high-pressure nozzles. The high volume of water used by the present invention pushes the flitches down onto the conveyor system to assure that the flitches are driven positively by the conveyor system drive through the washer.

The large volume of water directed toward the flitch at low pressure from several angles within the flitch washer washes out most of the sand, soils and the like. Higher pressure water sprays in prior art systems force sand, soils and the like deeper into the grain, the nap and crevices in the flitches, resulting in increased damage to veneer slicer blades, increased down time for veneer slicers for blade maintenance and reduced yields from the veneer slicers. In addition, the prior art systems' high pressure damages the wood fibers.

Figure 12:
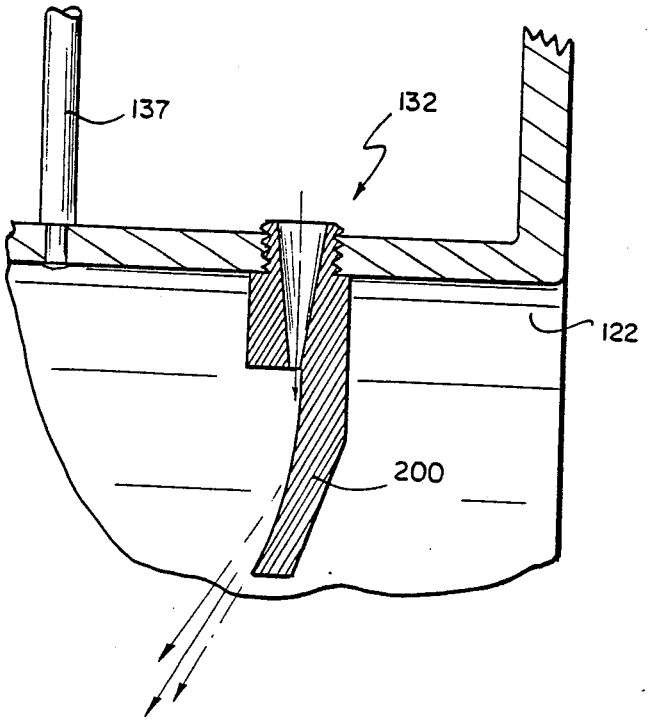
FIG. 12 is an enlarged detail of the flitch washer of FIGS. 7–10.

Since the flitch washers of the present invention train sprays of water on the ends of the flitches at the inlet and outlet ends of the flitch washer, the ends of the flitches are cleaned adequately and do not need to be removed and discarded, as is required with prior art systems, to place the flitches in condition for slicing. To aid in washing the ends of the flitches and to help capture washing fluid vapor within the flitch washer, the nozzles 132 in the end, generally vertically extending rows 134 may be specially configured with hoods 200, FIG. 12, which deflect the washing fluid sprays from these nozzles 132 inwardly into the flitch washer, rather than straight across diameters of cylinder 122 in curtain-like fashion.

Figure 13:
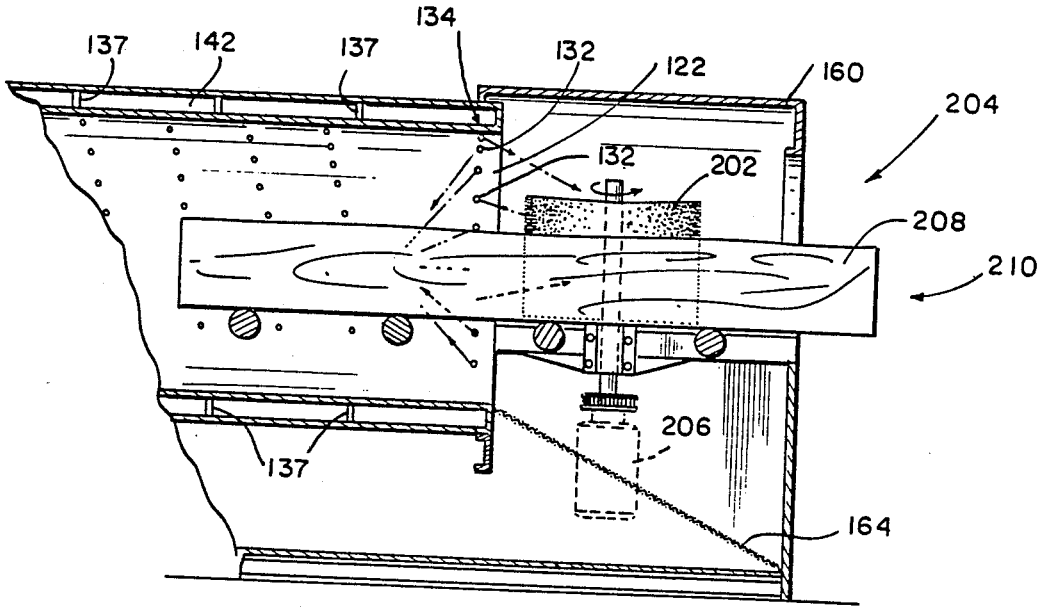
FIG. 13 is an enlarged detail of another embodiment of the flitch washer of the present invention.
Figure 14:
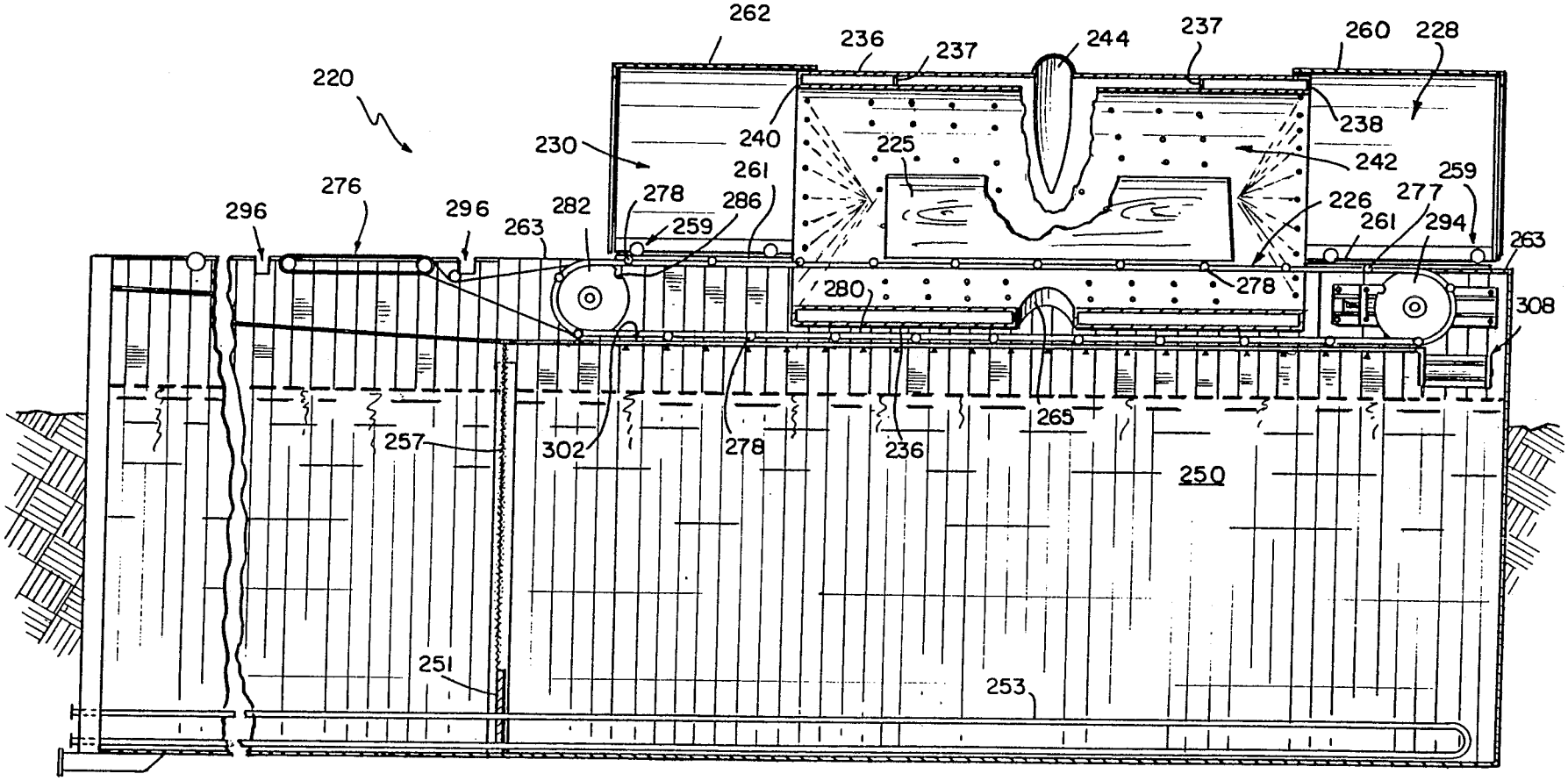
FIG. 14 is a fragmentary longitudinal sectional elevational view of another embodiment of the flitch washer.

In one embodiment of the invention, illustrated in FIG. 13, stiff wire brushes 202 are provided on the inlet end 204 of a flitch washer. Means such as motors 206 are provided for driving the brushes 202 to rotate against the surfaces 208 of the flitches 210 which pass through the washer. Some of the jets 132 of the type illustrated in FIG. 12 at the inlet end 204 of the washer are turned so as to be trained upon the brushes 202 to keep wood fibers and debris removed from the flitches 210 by the brushes 202 from accumulating on the brushes 202.

Prior art high pressure washing jets with carbide tips are expensive, costing about $60 apiece. Even jets with carbide tips wear out from grit and sand abrasion because of the high pressure at which water is forced through them in such prior art systems. The jets 32, 132 of the present invention, on the other hand, are constructed from stainless steel and have rather larger diameter jet openings (approximately one-eighth inch—3.2 mm) than prior art jets. This size is perfectly acceptable at the lower pressure of the present invention because of the high volume of water which is circulated through the system. If sand, grit, soils and the like wear on the jets 32, 132, such wear is perfectly acceptable since it serves only to make the nozzle openings larger and permit water to circulate through the system at a higher rate.

With particular reference to FIGS. 14–17, a flitch washer 220 includes an outer, generally right circular cylinder 236 which is attached intermediate its ends by rod-like spacer/supports 237 to the intermediate regions of an inner, generally right circular cylinder 222 to form a volume 242. Outer cylinder 236 is also attached at its ends by bulkheads 238, 240 to the ends of cylinder 222. Cylinder 236 is provided with a washing fluid supply opening 244 (FIGS. 14, 17) which is coupled by means of a conduit (not shown) to a high-volume, low-pressure pump 246 (FIGS. 15, 17) which pumps washing fluid into the volume 242.

A well 250 communicates by means of a line 249 (FIGS. 15, 17) to the inlet to the high-volume, low-pressure pump 246. The wall of well 250 is constructed from a durable material which is non-reactive with the washing fluid and other materials with which the washing fluid becomes contaminated during use. A heavy-guage corrugated sheet stainless steel is illustrated in this embodiment. The well 250 includes a sand trap 251 in the form of a solid baffle, and a heating coil 253 that is thermostatically controlled. Well 250 includes a filter screen 257 extending upward from the top of trap 251 to prevent large floating material that is not trapped by trap 251 from entering the recirculation system.

The entry end 228 and exit end 230 of a flitch passageway 224 are provided with respective entry end hood 260 and exit end hood 262. Hoods 260, 262 are provided with V-grooved wheels 259 which permit them to roll on inverted V-shaped tracks 261 provided on the flat top edge surface 263 of well 250. Hoods 260, 262 aid in preventing the escape of, and help to collect, washing fluid in well 250 for recirculation. A somewhat oval-shaped drain 265 is provided through the walls of both cylinders 222, 236 at the bottom center of passageway 224 for this purpose. The orientation of the drain 265, with its long axis extending generally circumferentially around the cylinders 222, 226, also helps channel the high volume of water into the two ends of the volume 242.

Figure 15:
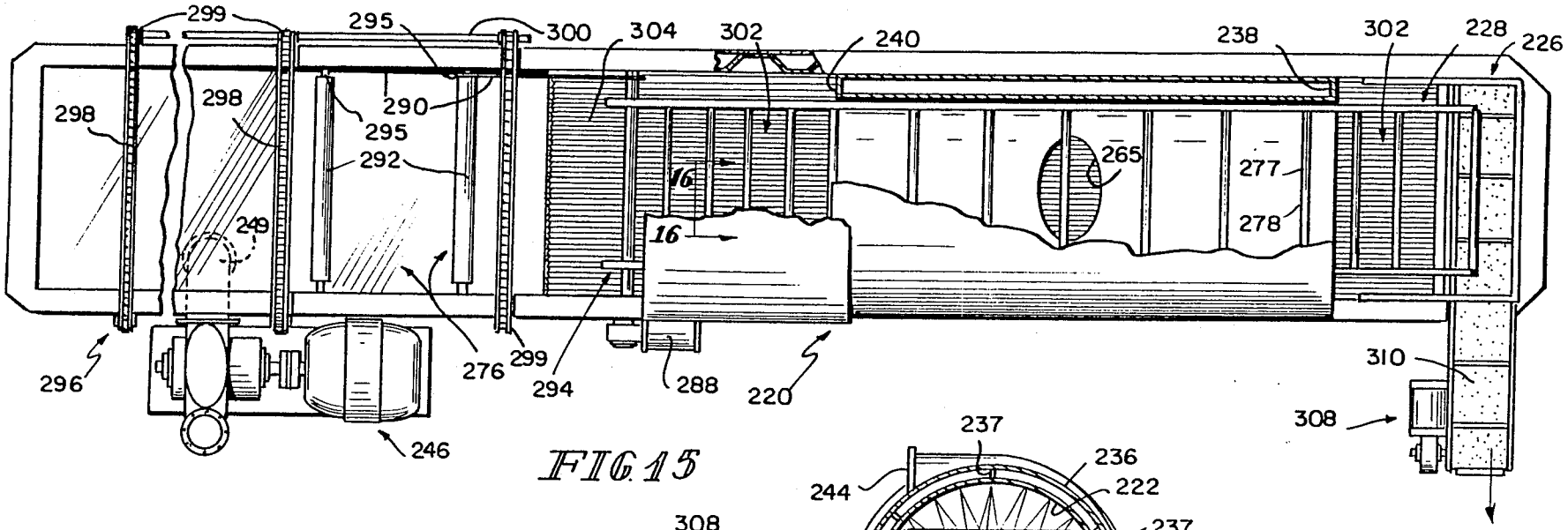
FIG. 15 is a fragmentary longitudinal top plan view, partly broken away, of the flitch washer of FIG. 14.
Figure 17:
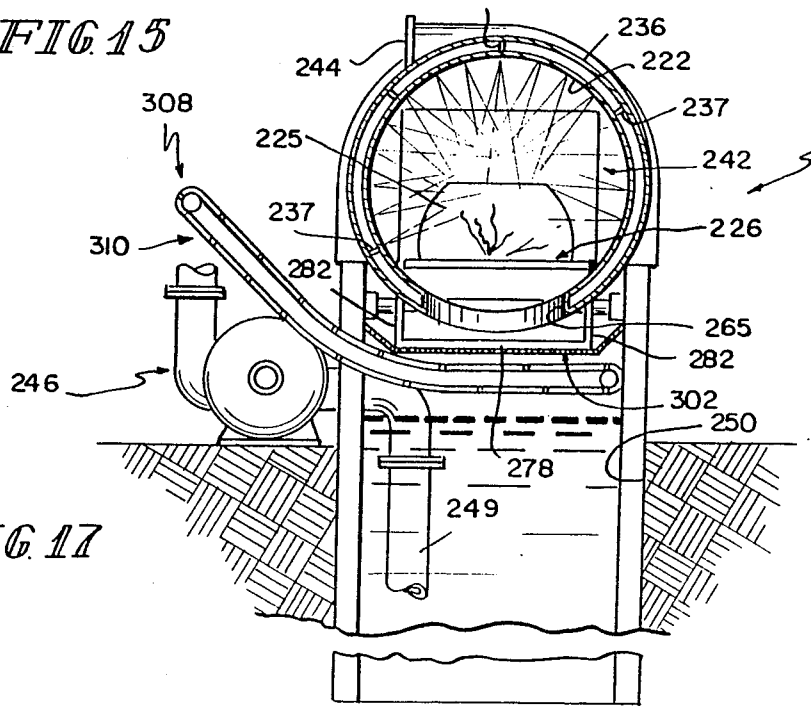
FIG. 17 is a sectional view of the flitch washer of FIGS. 14–15, taken generally along lines 17–17 of FIG. 15.
Figure 16:
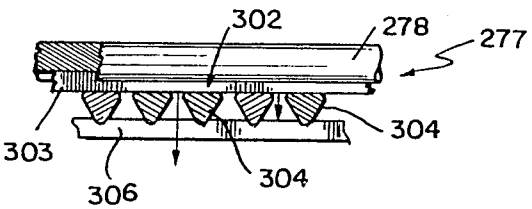
FIG. 16 is an enlarged sectional view of a detail of the flitch washer of FIGS. 14–15 taken generally along section lines 16—16 of FIG. 15.

The conveyor 226 includes a main conveyor section 277, which extends the entire length of washer 220. Conveyor section 277 includes a pair of spaced chains 280 between which extend, at equal intervals, circular cross-section rods 278. Rods 278 are constructed from a material which is generally non-reactive with the washing fluid and other materials with which the washing fluid becomes contaminated during use. Each continuous chain 280 is trained about a respective pair of sprockets 282, 294 at each end of the washer 220. The sprockets 282 and 294 include spaced notches 286 about their peripheries to engage rods 278 and drive flitches 225 along conveyor section 277 and through the washer 220. Sprockets 282 are driven by a motor 288 (FIG. 15). The conveyor 226 also includes an exit conveyor portion 276 with rotably mounted rollers 292, each of which includes a drive sprocket 295 at one end.

A drive chain 290 is trained about the sprocket 295 of the end roller 292 nearest sprockets 282. The flitch 225 is carried by the exit conveyor 276 to a transversely extending off-loading conveyor 296 that includes a plurality of conveyor chains 298 trained about respective sprockets 299 and driven from a common shaft 300. The conveyor chains 298 drive the flitch 225 transverse to conveyor 276 off conveyor 276.

A grid 302 extends along the entire length of washer 220 below and adjacent to conveyor 277. The grid includes a plurality of longitudinally extending members 304 that are somewhat triangular in cross section (see FIG. 16) and a plurality of transverse, supporting members 306 that have generally the same cross-section. The members 304, 306 are welded or otherwise joined to form grid 302 beneath conveyor 277. The members 304 of grid 302 are sufficiently closely spaced to prevent larger pieces of bark and other such debris from filtering down into well 250. Rods 278 are provided with longitudinally extendng rubber wipers 303. Wipers 303 are fitted by sliding them into longitudinally extending slots in the sidewalls of rods 278. As rods 278 are driven by chains 280, wipers 303 wipe the top surface of the grid 302, pushing all of the collected debris to a conveyor 308 which transports the debris to a refuse container (not shown). Conveyor 308 includes an elevator section 310 (FIG. 17) to permit use of a large refuse container of several commercially available types known as "dumpsters," facilitating waste removal.

What is claimed is:

1. A washer for a flitch or the like comprising means defining a passageway open at an entry end and an exit end, means for conveying a flitch through the passageway from the entry end to the exit end, means defining a plurality of openings along the walls of the passageway for discharging a washing fluid into the passageway, means for supplying washing fluid to the openings, means for recycling said washing fluid, means including a filter that permits drainage of said washing fluid into said means for recycling said washing fluid for trapping debris beneath the means for conveying a flitch, and means for conveying the trapped debris away from the washer.

2. The washer of claim 1 wherein the means for conveying the trapped debris away from the washer includes means for wiping a top surface of the filter, the wiping means being provided on said means for conveying a flitch.

3. The washer of claim 2 wherein the means for conveying the trapped debris includes means for collecting the debris wiped from the filter and for conveying the wiped debris to a debris container.

4. A washer for a flitch or the like comprising an inner first generally right circular cylinder defining a passageway open at an entry end and an exit end, means for conveying a flitch through the passageway from the entry end to the exit end, an outer second generally right circular cylinder having an axis extending generally parallel to the axis of the inner cylinder and ends adjacent the entry and exit ends of the passageway and means for closing the spaces between the ends of the outer cylinder and the inner cylinder to define a volume between them, means for providing washing fluid at high volume through the outer cylinder and into the volume to supply washing fluid to the volume, means defining openings through the first cylinder communicating with the volume between the first and second cylinders, and a plurality of plugs and nozzles for engaging the openings, the nozzles and plugs engaging the openings in a selected pattern to provide a selected spray pattern for washing fluid into the passageway, means for recycling said washing fluid, means for trapping debris beneath the means for conveying a flitch, and means for conveying the trapped debris away from the washer.

5. The washer of claim 4 wherein nozzles at the entry end and exit end of the passageway are configured to direct washing fluid longitudinally inward into the flitch washer, whereby the ends of the flitch are sprayed with washing fluid and cleaned as the flitch is conveyed into the entry end and out the exit end of the flitch washer.

6. A flitch washer comprising means defining a passageway open at an entry end and an exit end, an endless conveyor for conveying a flitch through the passageway from the entry end to the exit end, the endless conveyor comprising a conveying run which extends through the passageway and a return run, means for powering the endless conveyor to convey flitches disposed on the conveying run from the entry end to the exit end and to drive the return run from the exit end to the entry end, means defining a plurality of openings along the walls of the passageway for discharging a washing fluid into the passageway, means for supplying washing fluid to the openings, means for recycling said washing fluid, a filter for trapping debris resulting from washing of the flitch, the filter including a filter element disposed adjacent the return run of the endless conveyor, the endless conveyor including means for conveying accumulated debris on the filter element toward the entry end and means for conveying the debris conveyed by the return run away from the washer.

7. The flitch washer of claim 6 wherein the means for conveying the debris away from the washer comprises a second conveyor, means for positioning the second conveyor adjacent the filter element and the entry end, debris conveyed by the return run being deposited upon the second conveyor and conveyed away from the entry end to a remote location for collection and disposal.

8. The flitch washer of claim 6 wherein the filter element comprises a plurality of supports extending generally transversely to the longitudinal extent of the first-mentioned conveyor and a plurality of filter bars extending generally transversely to the supports and longitudinally of the longitudinal extent of the first-mentioned conveyor.

9. The flitch washer of claim 8 wherein at least some of the supports and at least some of the filter bars are triangular in cross section, each having an apex and an opposed flat side, and the triangular filter bars are connected to the triangular supports on apices of the triangular supports and apices of the filter bars.

10. The flitch washer of claim 6 wherein the return run is disposed outside the passageway.

11. The flitch washer of claim 10 wherein the filter element is disposed outside the passageway.

12. The washer of claim 6 comprising an inner first cylinder defining the passageway open at an entry end and an exit end, said washing fluid supply means comprising an outer second cylinder having an axis extending generally parallel to the axis of the inner cylinder and having ends adjacent the entry and exit ends of the passageway, means for closing the spaces between the ends of the outer cylinder and the inner cylinder to define a volume between them and means for providing washing fluid at high volume through the outer cylinder and into the volume to supply washing fluid to the openings.

13. The washer of claim 12 wherein the first and second cylinders are generally right circular cylinders.

14. The washer of claim 12 wherein the means defining a plurality of openings along the walls of the passageway comprises means defining openings through the first cylinder communicating with the volume between the first and second cylinders, and a plurality of plugs and nozzles for engaging the openings, the nozzles and plugs engaging the openings in a selected pattern to provide a selected spray pattern of washing fluid into the passageway.

15. The washer of claim 14 wherein nozzles at the entry end and exit end of the passageway are configured to direct washing fluid longitudinally inward into the flitch washer, whereby the ends of the flitch are sprayed with washing fluid and cleaned as the flitch is conveyed into the entry end and out the exit end of the flitch washer.

* * * * *